US010683779B2

(12) United States Patent
Altherr et al.

(10) Patent No.: US 10,683,779 B2
(45) Date of Patent: Jun. 16, 2020

(54) VALVE TRAIN FOR A RECIPROCATING PISTON INTERNAL COMBUSTION ENGINE, AND METHOD FOR VALVE CONTROL IN A RECIPROCATING PISTON INTERNAL COMBUSTION ENGINE

(71) Applicant: Mahle International GmbH, Stuttgart (DE)

(72) Inventors: Patrick Altherr, Stuttgart (DE); Christoph Beerens, Stuttgart (DE); Thomas Flender, Eberdingen (DE); Herrn Rolf Kirschner, Esslingen (DE); Sascha Naujoks, Pfinztal (DE)

(73) Assignee: Mahle International GmbH (DE)

( * ) Notice: Subject to any disclaimer, the term of this patent is extended or adjusted under 35 U.S.C. 154(b) by 27 days.

(21) Appl. No.: 15/879,428

(22) Filed: Jan. 24, 2018

(65) Prior Publication Data

US 2018/0216502 A1 Aug. 2, 2018

(30) Foreign Application Priority Data

Jan. 27, 2017 (DE) ..... 10 2017 201343

(51) Int. Cl.
*F01L 1/344* (2006.01)
*F01L 13/00* (2006.01)
(Continued)

(52) U.S. Cl.
CPC ..... *F01L 1/344* (2013.01); *F01L 1/047* (2013.01); *F01L 1/08* (2013.01); *F01L 13/0036* (2013.01);
(Continued)

(58) Field of Classification Search
CPC ..... F01L 1/344; F01L 13/0036; F01L 13/06; F01L 1/047; F01L 1/08; F01L 2001/0537;
(Continued)

(56) References Cited

U.S. PATENT DOCUMENTS 5,417,186 A * 5/1995 Elrod ..... F01L 1/02 123/90.17
8,117,748 B2 2/2012 Clever et al.
(Continued)

FOREIGN PATENT DOCUMENTS

DE 19733322 A1 2/1999
DE 102007007758 A1 8/2008
(Continued)

OTHER PUBLICATIONS

English abstract for DE-19733322.

*Primary Examiner* — Patrick Hamo
*Assistant Examiner* — Wesley G Harris
(74) *Attorney, Agent, or Firm* — Fishman Stewart PLLC

(57) ABSTRACT

A valve train for a reciprocating piston internal combustion engine may include a crankshaft, at least one inlet valve, at least one outlet valve, at least one camshaft coupled rotationally to the crankshaft, at least one inlet cam held on a first camshaft, at least one outlet cam held on one of the first camshaft or a second camshaft, at least one brake cam held on one of the first camshaft or the second camshaft, at least one inlet cam follower, which may actuate the at least one inlet valve and may be drive-connected at least at times to the inlet cam, at least one outlet cam follower, which may actuate the at least one outlet valve, may be drive-connected at least at times to the outlet cam, and, in a braking mode, may be drive-connected at least at times to the brake cam, and a phase shifting device for adjusting a phase position of the brake cam relative to the crankshaft.

14 Claims, 5 Drawing Sheets

(51) Int. Cl.

| | |
|---|---|
| ***F01L 13/06*** | (2006.01) |
| ***F01L 1/047*** | (2006.01) |
| ***F01L 1/08*** | (2006.01) |
| ***F02D 13/02*** | (2006.01) |
| *F02D 13/04* | (2006.01) |
| *F01L 1/053* | (2006.01) |

(52) U.S. Cl.
CPC ..... *F01L 13/06* (2013.01); *F02D 13/02* (2013.01); *F01L 2001/0537* (2013.01); *F01L 2013/0052* (2013.01); *F02D 13/0234* (2013.01); *F02D 13/04* (2013.01)

(58) Field of Classification Search
CPC ..... F01L 2013/0052; F01L 2001/0473; F02D 13/02; F02D 13/0234; F02D 13/04; Y02T 10/18
USPC ..... 123/90.15, 90.17, 90.16, 90.18
See application file for complete search history.

(56) References Cited

U.S. PATENT DOCUMENTS

| | | | | |
|---|---|---|---|---|
| 9,080,472 | B2 | 7/2015 | Blaxill et al. | |
| 2010/0180860 | A1 | 7/2010 | Hergert et al. | |
| 2016/0090921 | A1* | 3/2016 | Choi | F02D 13/06 123/90.18 |
| 2016/0281612 | A1 | 9/2016 | Toth et al. | |
| 2017/0122141 | A1* | 5/2017 | Nishimura | F01L 1/344 |

FOREIGN PATENT DOCUMENTS

| | | | |
|---|---|---|---|
| DE | 102007038078 | A1 | 2/2009 |
| DE | 102009043390 | A1 | 7/2010 |
| DE | 102013215946 | A1 | 2/2015 |

* cited by examiner

VALVE TRAIN FOR A RECIPROCATING PISTON INTERNAL COMBUSTION ENGINE, AND METHOD FOR VALVE CONTROL IN A RECIPROCATING PISTON INTERNAL COMBUSTION ENGINE

CROSS-REFERENCE TO RELATED APPLICATIONS

This application claims priority to German Patent Application No. DE 10 2017 201 343,5, filed on Jan. 27, 2017, the contents of which are incorporated herein by reference in its entirety.

TECHNICAL FIELD

The invention relates to a valve train for a reciprocating piston internal combustion engine having at least one inlet valve and at least one outlet valve, and having at least one camshaft which is coupled rotationally to a crankshaft of the reciprocating piston internal combustion engine. Furthermore, the invention relates to a method for valve control in a reciprocating piston internal combustion engine having a valve train of this type.

BACKGROUND

It is customary in commercial vehicles to use the internal combustion engine to assist the braking system and to reduce the brake system wear. Various systems are used to increase the braking performance of the internal combustion engine. It is known from the prior art to increase the braking performance via a corresponding valve lift curve. Here, for example, an additional cam can be activated or a completely new valve lift curve can be set by way of a switchover cam. Although an increased braking action can be achieved by way of the additional cam being switched in, the said braking action nevertheless cannot be set.

SUMMARY

The invention is based on the object of providing an improved or at least different embodiment of a valve train and a method for valve control, which embodiment is distinguished, in particular, by a controllable braking performance in a braking mode.

According to the invention, the said object is achieved by way of the subjects of the independent claims. Advantageous developments are the subject matter of the dependent claims.

The invention is based on the general concept of influencing the braking action by way of shifting of the phase position of the brake cam. It is therefore provided according to the invention that the valve train has a phase shifting device for adjusting a phase position of the brake cam relative to a crankshaft. The shifting of the phase position can influence, for example, how much gas is already let out of the cylinder via the outlet valves in the compression phase. The braking performance which occurs can be influenced as a result. Phase shifting devices of this type are known in the field of reciprocating piston internal combustion engines and are used to shift the outlet valve opening times or inlet valve opening times, in order to make either particularly efficient or particularly effective operation of the reciprocating piston internal combustion engine possible.

One favourable option provides that the valve train has at least one first camshaft and at least one second camshaft, that the inlet cam is held on the first camshaft, that the outlet cam is held on the second camshaft, and that the brake cam is held on the second camshaft. As a result, the phase shift of the brake cam can be set together with the phase shift of the outlet cam. A phase shifting device which sets the phase of the outlet cam is already present in most modern reciprocating piston internal combustion engines. In order to achieve the braking mode, the brake cam is either switched in and acts together with the outlet cam on the outlet cam follower, or a switchover is carried out between the outlet cam and the brake cam, with the result that exclusively the brake cam acts on the outlet cam follower in the braking mode.

A further favourable option provides that the phase shifting device is configured in such a way that the phase shifting device can adjust and/or adjusts at least one phase position of the second camshaft with respect to the crankshaft. By virtue of the fact that the phase position of the second camshaft with respect to the crankshaft can be adjusted or is adjusted, the phase positions of the brake cams which are held on the second camshaft with respect to the crankshaft are also adjusted, with the result that the braking action can be set in the braking mode by way of the phase shifting device.

One particularly favourable option provides that the inlet cam, the outlet cam and the brake cam are held on the first camshaft, and that the camshaft has a hollow shaft (outer shaft) and an inner shaft which runs in the hollow shaft, which shafts can be rotated relative to one another by way of the phase shifting device. In the case of what is known as the "cam-in-cam" technology, a phase position can be set between the cams. This is an option known from the prior art for adjusting the phase position and has already been proven in operation, with the result that it can be used in a favourable way for adjusting the phase position of the brake cam.

One advantageous solution proposes that the inlet cam is held on the hollow shaft, and the outlet cam is held together with the brake cam on the inner shaft, or vice versa. As a result, the phase positions of the outlet cam and the brake cam are adjusted synchronously. This is of interest, for example, if a switchover is carried out from the outlet cam to the brake cam in the braking mode. As a result, the phase shifting device can be used in the normal mode to set the phase position of the outlet cam and in braking mode to set the phase position of the brake cam. There is a dual utilization of the phase shifting device as a result.

One particularly advantageous solution provides that the inlet cam is held together with the outlet cam on the hollow shaft, and the brake cam is held on the inner shaft, or vice versa. As a result, the phase position of the brake cam can be set independently of the inlet cam and independently of the outlet cam. This is particularly favourable when a brake cam which can be switched in is used.

A further particularly advantageous solution provides that a connecting apparatus is provided which can be switched over between a braking position and a normal position, the outlet cam follower being drive-connected only to the outlet cam in the normal position, and the outlet cam follower being drive-connected to the brake cams and the outlet cam in the braking position. As a result, the valve opening characteristic curve can be extended with the aid of the brake cam, with the result that the valve is open over a longer time period. For example, the outlet valve can be opened during the compression process or the expansion process, which leads to it being possible for less energy to be recovered during the expansion than was consumed during the compression. The desired braking action or increase in the braking action is produced as a result.

One favourable variant provides that a switchover apparatus is provided which can switch over between a braking position and a normal position, the outlet cam follower being drive-connected to the brake cam in the braking position, and the outlet cam follower being drive-connected to the outlet cam in the normal position. Here, a switchover is therefore carried out between the normal position and the braking position between the brake cam and the outlet cam. As a result, there are even more degrees of freedom for influencing the valve opening characteristic curve of the outlet valve. For example, the outlet valve can be opened only partially in the exhaust stroke, with the result that throttling losses occur in the cylinder as a result of the ejection of the gases.

One particularly favourable variant provides that the outlet cam follower has an adjusting device which interacts with the camshaft for the axial adjustment of the outlet cam follower between the normal position and the braking position. As a result, the outlet cam follower can be switched to and fro between the outlet cam and the brake cam, with the result that there is a switchover apparatus.

As an alternative or in addition to this, it can be provided that an adjusting device which interacts with the camshaft is provided, which adjusting device can adjust the outlet cam and the brake cam in the axial direction on the camshaft. As a result, a switch can likewise be carried out between the outlet cam and the brake cam.

One advantageous option provides that the brake cam and the outlet cam are arranged axially directly next to one another. As a result, a changeover between the outlet cam and the brake cam is facilitated.

Furthermore, the invention is based on the general concept of using a valve train according to the preceding description in a method for valve control in a reciprocating piston internal combustion engine, the outlet cam followers being drive-connected exclusively to the outlet cam in a normal mode of the internal combustion engine, whereas the outlet cam followers are drive-connected to the brake cam in a braking mode, and a phase position of the brake cams with respect to the crankshaft being adjusted in the braking mode in order to influence the braking action. The action of the brake cam can be varied by way of the adjustment of the phase position of the brake cam with respect to the crankshaft, with the result that the braking action can be set.

One expedient solution provides that the phase position of the brake cams is shifted in the early or late direction in order to set the braking performance. The pressure ratios in the respective cylinder during the exhaust stroke are influenced by way of the shift of the phase position in the early or late direction, with the result that the braking action can be influenced.

A further advantageous option provides that the phase position of the brake cams is shifted in the late direction in order to increase the braking action, and that the phase position of the brake cams is shifted in the early direction in order to reduce the braking action. If the phase position is shifted in the late direction, higher pressures occur in the cylinder in the exhaust stroke of the reciprocating piston internal combustion engine, which higher pressures lead to a braking action.

One favourable solution provides that the phase position of the brake cam with respect to the crankshaft is set independently of a phase position of the inlet cam with respect to the crankshaft. As a result, the braking action can be set, without the intake of fresh air being influenced, which is favourably advantageous for the inflow of a turbocharger.

A further particularly advantageous solution provides that the phase position of the brake cam with respect to the crankshaft is set independently of a phase position of the outlet cam with respect to the crankshaft. The shift of the phase position of the outlet cam excessively in the late direction might lead to overlaps as far as into the intake stroke of the reciprocating piston internal combustion engine, which would be unfavourable.

Further important features and advantages of the invention result from the subclaims, from the drawings and from the associated description of the figures using the drawings.

It goes without saying that the features which are mentioned in the preceding text and are still to be described in the following text can be used not only in the respectively specified combination, but rather also in other combinations or on their own, without departing from the scope of the present invention.

Preferred exemplary embodiments of the invention are shown in the drawings and will be described in greater detail in the following description, identical reference numerals relating to identical or similar or functionally identical components.

BRIEF DESCRIPTION OF THE DRAWINGS

In the drawings, in each case diagrammatically.

DETAILED DESCRIPTION

Figure 1:
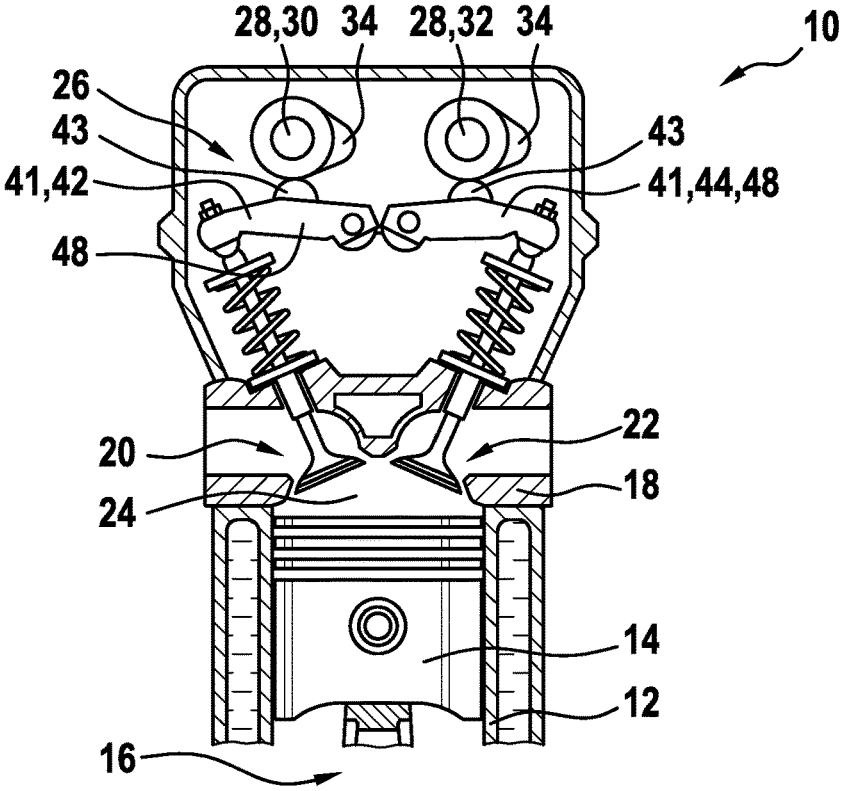
FIG. 1 shows a sectional illustration through a reciprocating internal combustion engine having two camshafts.
Figure 2:
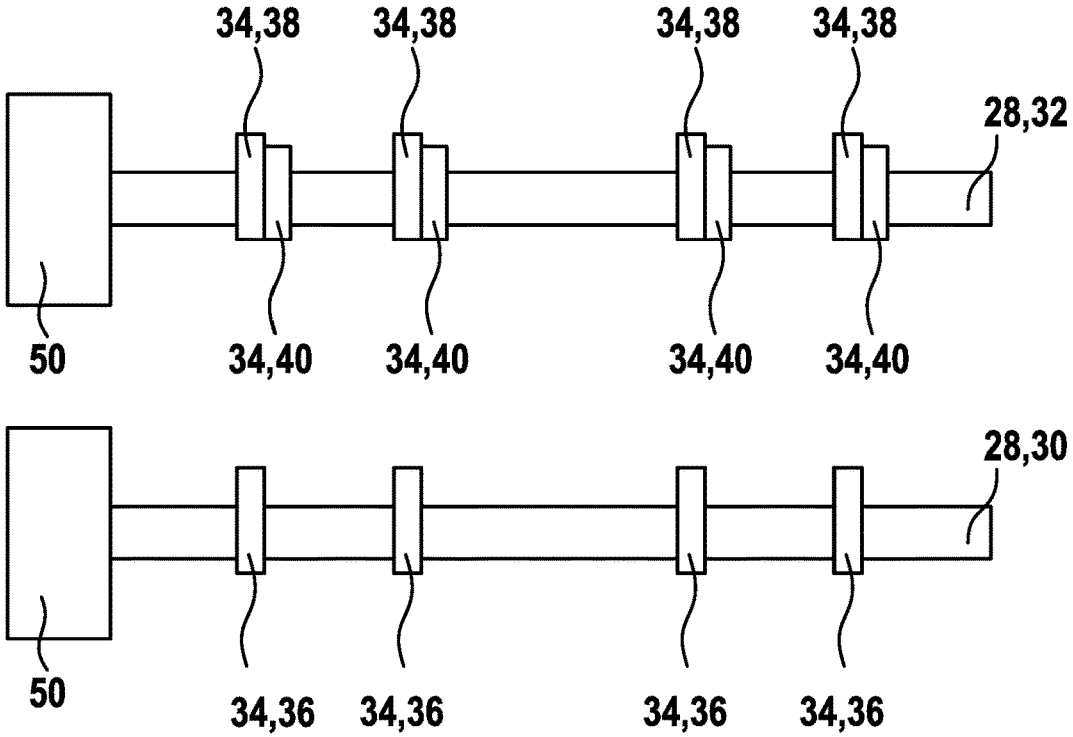
FIG. 2 shows an outline sketch of a phase shifting device for the two camshafts.

A first embodiment (shown in FIGS. 1 to 6) of a reciprocating piston internal combustion engine 10 comprises at least one cylinder 12 and one piston 14 which is arranged in the cylinder 12 such that it can be displaced linearly. Furthermore, the reciprocating piston internal combustion engine 10 has a crankshaft 16, by way of which the linear movement of the piston 14 is converted into a rotation. At least one, preferably two inlet valves 20 and at least one, preferably two outlet valves 22 are arranged in a cylinder head 18 of the reciprocating piston internal combustion engine 10. Gas, in particular fresh air, preferably fresh air which is mixed with fuel, can flow through the inlet valve 20 into a combustion chamber 24 which is formed in the cylinder 12. Gas, preferably combustion exhaust gas, can flow out of the combustion chamber 24 through the at least one outlet valve 22.

During operation of the reciprocating piston internal combustion engine 10, the inlet valves 20 and outlet valves 22 are actuated synchronously with respect to a movement of the piston 14 and therefore also synchronously with respect to the crankshaft 16. A valve train 26 is therefore usually provided, which valve train 26 has, for example, two camshafts 28 which are coupled rotationally to the crankshaft 16, with the result that the rotation of the camshafts 28 is synchronous with respect to the rotation of the crankshaft 16.

In the present embodiment, the valve train 26 has a first camshaft 30 and a second camshaft 32 which are provided in each case with cams 34. At least one inlet cam 36 is held on the first camshaft 30. At least one outlet cam 38 and at least one brake cam 40 are arranged on the second camshaft 32.

The at least one inlet cam 36 is drive-connected to the inlet valve 20. By virtue of the fact that the inlet cam 36 is held on the first camshaft 30, the movement or control of the inlet valve 20 is therefore synchronous with respect to a rotation of the crankshaft 16. An inlet cam follower 42 is preferably provided for the coupling between the inlet cam 36 and the inlet valve 20, which inlet cam follower 42 actuates the inlet valve 20 and is arranged such that it is drive-connected to the inlet cam 36. As a result, the degree of opening of the inlet valve 20 can be controlled via the contour of the inlet cam 36. A valve lift characteristic curve 56 (cf. FIGS. 5 and 6) of the inlet valve 20 is therefore defined by the contour of the inlet cam 36.

Moreover, the valve train 26 also has at least one outlet cam follower 44 which is arranged and configured in such a way that it actuates the outlet valve 22. The outlet cam follower 44 is drive-coupled at least at times to the outlet cam 38. As a result, the outlet cam 38 is drive-connected to the outlet valve 22 at least at times in order to actuate the outlet valve 22. The outlet cam follower 44 is drive-connected to the outlet cam 38, in particular, in a normal mode of the reciprocating piston internal combustion engine 10. In a braking mode, the outlet cam follower 44 is preferably drive-connected exclusively to the brake cam 40. As a result, the outlet valve 22 is controlled by way of the profile of the brake cam 40 in the braking mode.

The cam followers 41 preferably have a cam follower element 43 which is configured, for example, as a roller, bears against an outer face of the cams 34, and therefore follows the profile of the cams when the camshaft 28 rotates. As a result, the rotation of the camshaft 28 is converted into a lift movement, by way of which the valves, that is to say the inlet valve 20 and the outlet valve 22, can be activated or actuated.

In order to transmit the movement of the cam follower elements 43 to the respective valves, the cam followers 41 can have a rocker 46 or a lever 48.

The inlet cams 36 are arranged on the first camshaft 30. The first camshaft 30 therefore serves for inlet control into the cylinders 12. The outlet cams 38 are arranged on the second camshaft 32, with the result that the second camshaft 32 serves for outlet control. Furthermore, the at least one brake cam 40 is arranged on the second camshaft 32, which at least one brake cam 40 controls the outlet valve 22.

The reciprocating piston internal combustion engine 10 has a phase shifting device 50, by way of which a phase position of one of the camshafts 28 relative to the crankshaft 16 can be set. As a result, in particular, the phase position of the camshafts 28 can be set for moving the pistons 14 in the respective cylinders 12. The phase shifting device 50 can be formed, for example, by way of a hydraulic vane cell actuating device. Other phase shifting devices, by way of which the phase position of the camshafts with respect to the crankshaft 16 can be set, are likewise possible.

Figure 3:
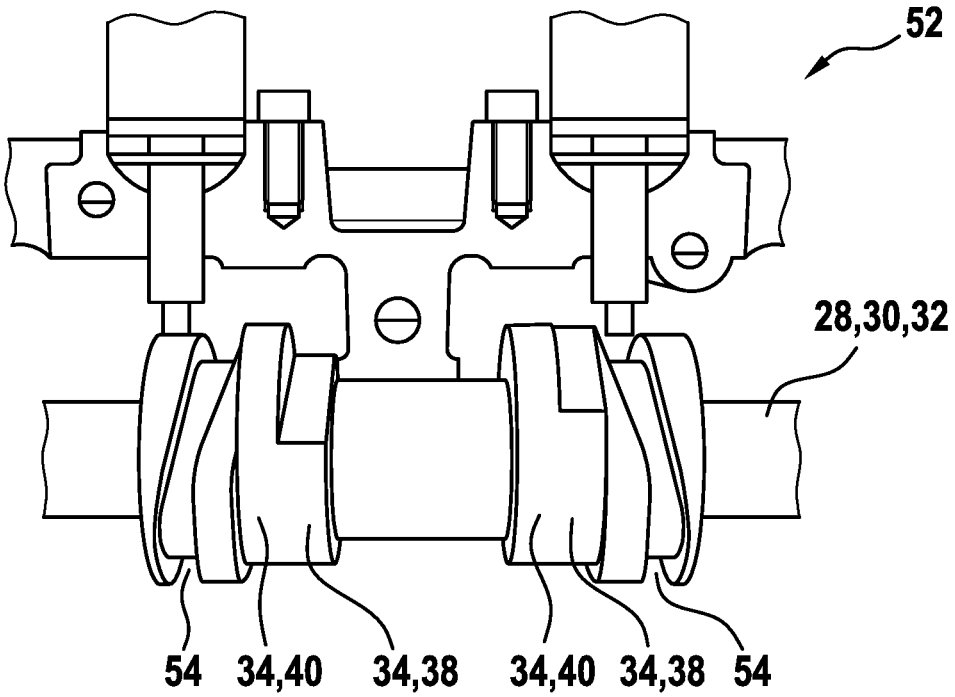
FIG. 3 shows one example for a switchover apparatus, for switching over between two cam profiles, in which the cams are displaced on the camshaft, in order to bring about the switchover.
Figure 4:
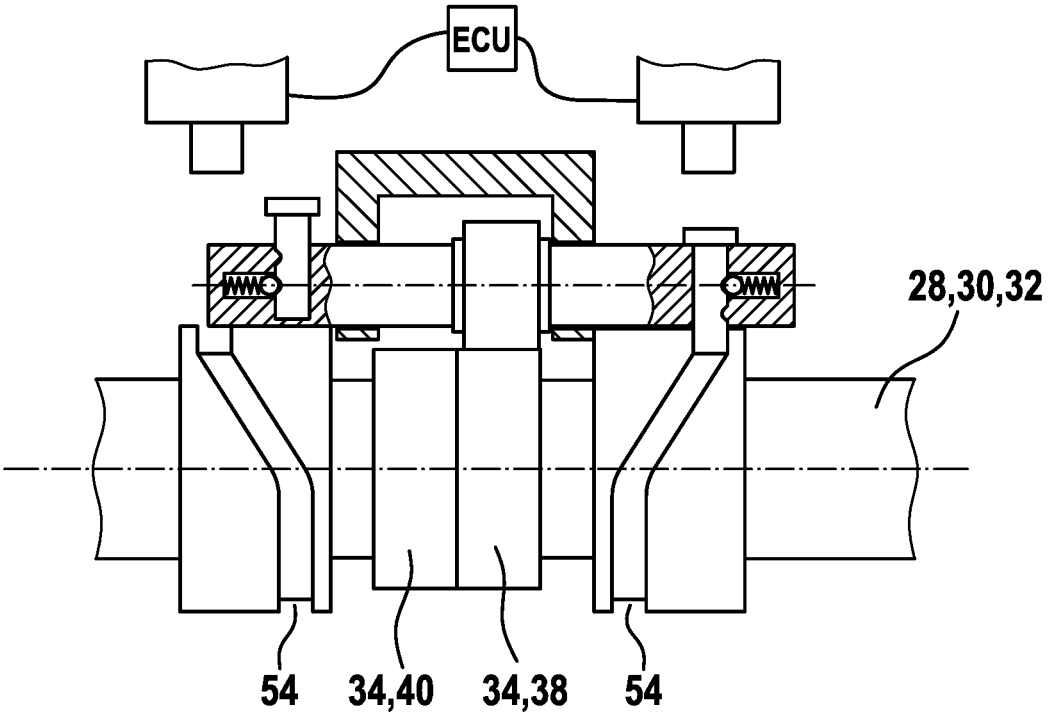
FIG. 4 shows an outline sketch of a switchover apparatus, in which a cam follower element is displaced in the axial direction, in order to switch over between two cam profiles.

FIGS. 3 and 4 show two different variants of a switchover apparatus 52, by way of which variants a switchover can be carried out between the outlet cam 38 and the brake cam 40. That is to say, the drive connection to the outlet valve 22 can be switched to and fro between the outlet cam 38 and the brake cam 40. In a braking position of the switchover apparatus 52 which is activated in the braking mode of the reciprocating piston internal combustion engine 10, the brake cam 40 is drive-connected to the outlet cam follower 44, with the result that the brake cam 40 controls the outlet valve 22. In a normal position of the switchover apparatus 52 which is set in the normal mode of the reciprocating piston internal combustion engine 10, the outlet cam 38 is drive-connected to the outlet cam follower 44, with the result that the outlet cam 38 controls the outlet valve 22.

The switchover apparatus 52 preferably has a control track 54 which is configured on the camshaft 28 and by way of which an axial displacement is made possible. In the variant which is shown in FIG. 3, the outlet cam 38 and the brake cam 40 are held on a sleeve which can be displaced axially on the camshaft 28. For switchover purposes, the sleeve and therefore the at least one outlet cam 38 and the at least one brake cam 40 are displaced on the second camshaft 32 in the axial direction. In the variant which is shown in FIG. 4, the cam follower element 43 of the outlet cam follower 44 is displaced in the axial direction, in order to switch over between the brake cam 40 and the outlet cam 38.

Figure 5:
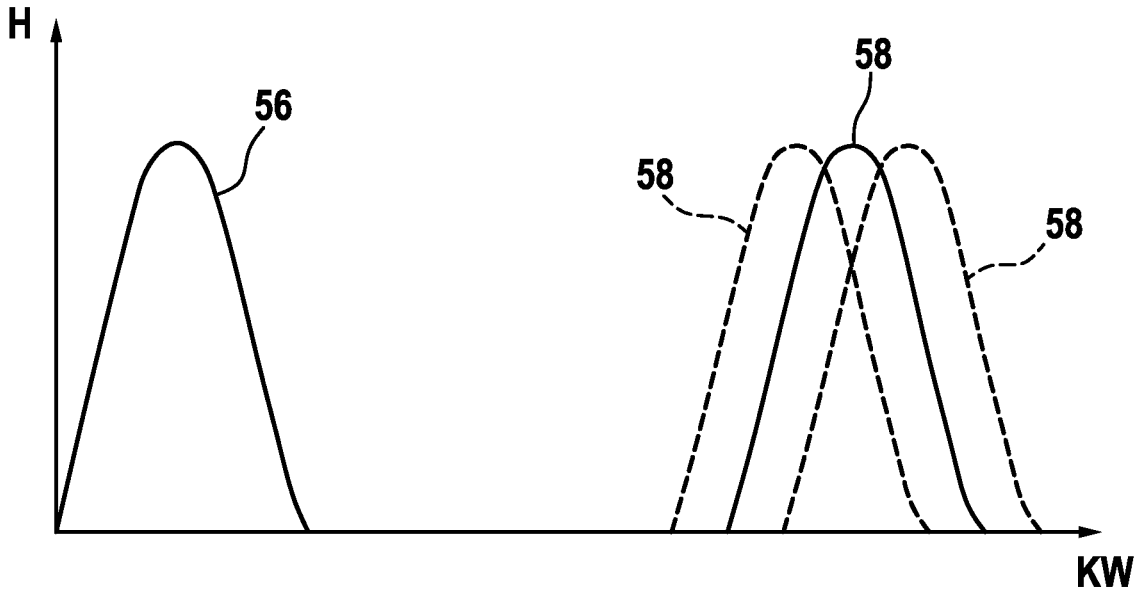
FIG. 5 shows a diagram with valve opening characteristic curves of an inlet valve and an outlet valve in order to illustrate the shift of the phase position of an outlet cam, in each case a valve lift H being shown plotted against a crank angle KW.
Figure 6:
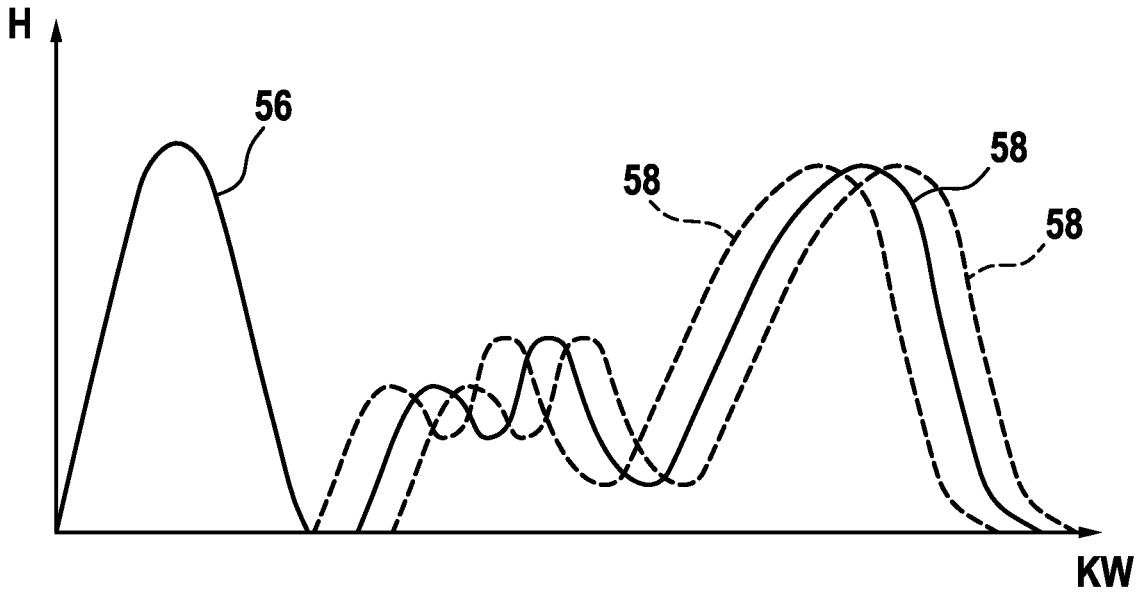
FIG. 6 shows a diagram with valve opening characteristic curves of the inlet valve and the outlet valve, in each case a valve lift H being shown plotted against a crank angle KW, a brake cam being active, and various phase positions of the brake cam being shown.

FIG. 5 shows two valve lift characteristic curves. In each case a valve lift H is shown plotted against a crank angle KW. A valve lift characteristic curve 56 of the inlet valve 20 is shown on the left-hand side in the diagram. A valve lift characteristic curve 58 of the outlet valve 22 is shown on the right-hand side in the diagram. The situation in FIG. 5 shows the normal position which is set in the normal mode of the reciprocating piston internal combustion engine 10, in which only the outlet cam 38 is drive-connected to the outlet valve 22 and therefore defines the valve lift characteristic curve 58 of the outlet valve 22.

The phase position of the valve lift characteristic curve 58 of the outlet valve 22 can then be adjusted by way of the phase shifting device 50. Thus, for example, the valve lift characteristic curve 58 can be displaced towards the left in the diagram, that is to say the valve can be opened earlier. This is then called a phase shift in the early direction. As an alternative, the valve lift characteristic curve 58 can be displaced towards the right in the diagram, with the result that the outlet valve 22 opens and closes later. This is then called a phase shift in the late direction.

FIG. 5 shows by way of example merely the phase shifting device 50 of the second camshaft 32, which phase shifting device 50 brings about a phase shift of the valve lift characteristic curve 58 of the outlet valve 22. It goes without saying that the phase shifting device 50 can also be configured in such a way that the phase position of the first camshaft 30 and therefore the phase position of the valve lift characteristic curve 56 of the inlet valve 20 can also be adjusted.

FIG. 6 again shows the valve lift characteristic curves 56 of the inlet valve 20 and the valve lift characteristic curve 58 of the outlet valve 22 in the braking mode. The respective valve lifts H are shown plotted against a crank angle KW. The switchover apparatus 52 is therefore situated in the braking position, in which the brake cam 40 is drive-connected to the outlet cam follower 44. The profile of the brake cam 40 therefore defines the valve lift characteristic curve 58 of the outlet valve 22. It can be seen that the valve lift characteristic curve 56 of the inlet valve 20 is unchanged in the braking mode with respect to the normal mode.

It can be seen in the case of the valve lift characteristic curve 58 of the outlet valve 22 that the outlet valve 22 opens at a considerably earlier stage in the braking mode than in the normal mode. As a result, the outlet valve 22 is already opened, for example, during the compressing of the gas, with the result that gas can flow out of the cylinder into the exhaust gas section. As a result, there is less gas in the cylinder during the subsequent expansion, with the result that the pressure during the expansion is lower and therefore less energy can be drawn again from the compressed gas than was previously introduced during the compressing. This results in a braking action.

Here, the phase shifting device 50 also brings about a phase adjustment of the second camshaft and therefore a shift of the valve lift characteristic curve 58 of the outlet valve 22 to the left or to the right and in the early direction or in the late direction. The braking action of the reciprocating piston internal combustion engine 10 which is brought about in the braking position can be set by way of the said phase shift.

A phase adjustment in the late direction brings about a higher braking action. A phase adjustment in the early direction brings about a weaker braking action.

Figure 7:
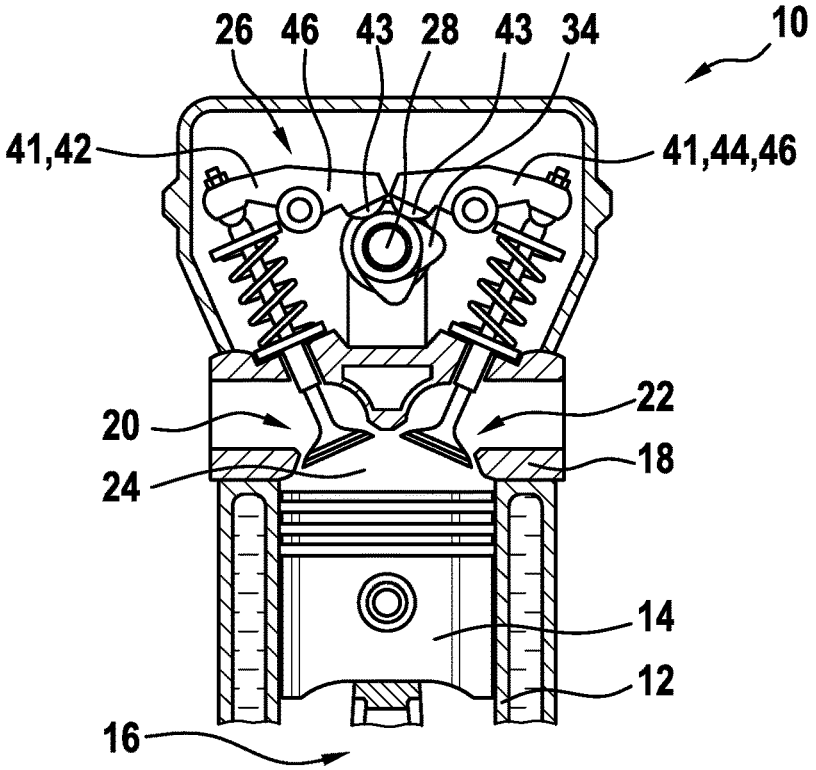
FIG. 7 shows a sectional illustration through a reciprocating piston internal combustion engine having a single camshaft.

A second embodiment (shown in FIGS. 7 and 8) of the reciprocating piston internal combustion engine 10 differs from the first embodiment (shown in FIGS. 1 to 6) of the reciprocating piston internal combustion engine 10 in that the reciprocating piston internal combustion engine 10 has a camshaft 28, on which all the required cams 34 are held. In particular, the at least one inlet cam 36, the at least one outlet cam 38 and the at least one brake cam 40 are held on the camshaft 28.

Figure 8:
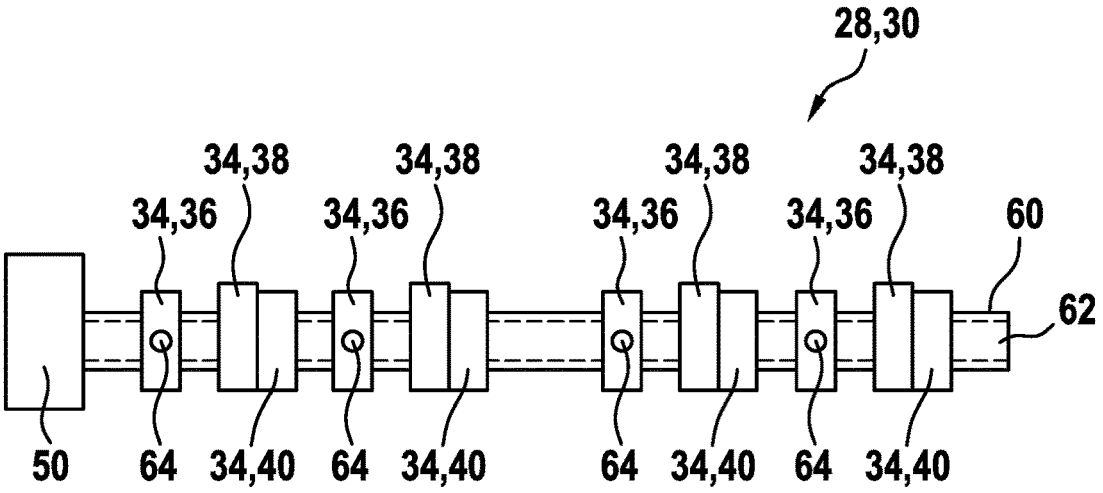
FIG. 8 shows an outline sketch of a phase shifting device in the case of a single camshaft, it being possible for the brake cam to be adjusted independently of the inlet cam.

In order to make a phase adjustment between the individual cams possible, the camshaft 28 has a hollow shaft 60 and an inner shaft 62 which is mounted rotatably in the hollow shaft 60. In the variant which is shown in FIG. 8, the at least one outlet cam 38 and the brake cam 40 are held jointly on the hollow shaft 60. The at least one inlet cam 36 is connected fixedly to the inner shaft 62 so as to rotate with it. The connection takes place, for example, via a pin 64 which engages through a slot which runs in the hollow shaft 60 in the circumferential direction, in order to connect the inlet cam 36 which is mounted rotatably on the hollow shaft 60 to the inner shaft 62 fixedly so as to rotate with it.

It goes without saying that, as an alternative, the brake cam 40 and the outlet cam 38 can be held on the inner shaft 62, and the inlet cam 36 can be held on the hollow shaft 60.

The switchover apparatus 52 is configured in accordance with the first embodiment, with the result that the phase shifting device 50 brings about an adjustment of the phase of the brake cam 40 in the normal mode and brings about an adjustment of the phase of the brake cam 40 in the braking mode.

Otherwise, the second embodiment (shown in FIGS. 7 and 8) of the reciprocating piston internal combustion engine 10 corresponds to the first embodiment (shown in FIGS. 1 to 6) of the reciprocating piston internal combustion engine 10 with regard to the construction and function; to this extent, reference is made to the above description of the said first embodiment.

Figure 9:
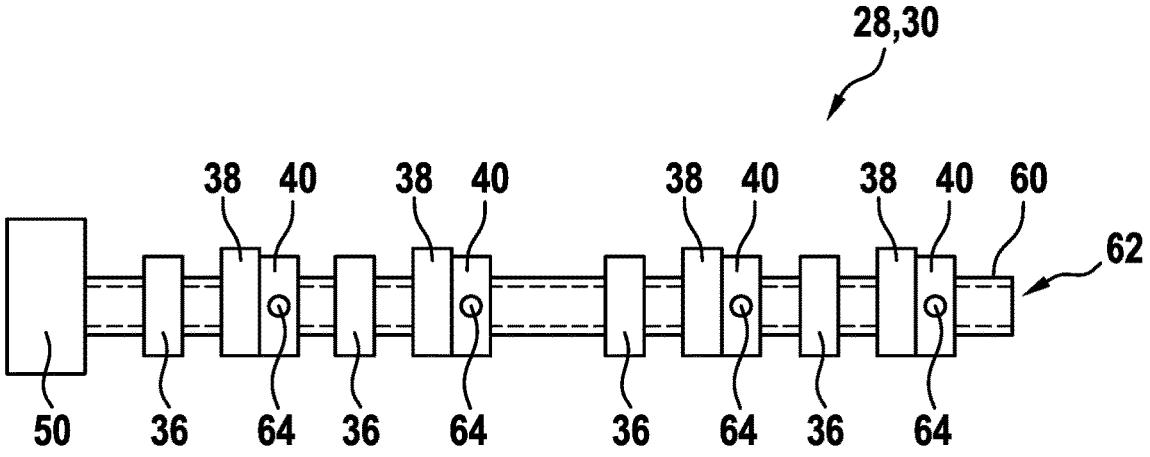
FIG. 9 shows an outline sketch for a phase shifting device in the case of a single camshaft, it being possible for the brake cam to be adjusted independently of the inlet cam and of the outlet cam.

A third embodiment (shown in FIGS. 9 and 10) of the reciprocating piston internal combustion engine differs from the second embodiment (shown in FIGS. 7 and 8) of the reciprocating piston internal combustion engine 10 in that the at least one inlet cam 36 and the at least one outlet cam 38 are jointly held fixedly on the hollow shaft 60 so as to rotate with it, whereas the brake cam 40 is held fixedly via the pin 64 on the inner shaft 62 so as to rotate with it. It goes without saying that, as an alternative, the brake cam 40 can be held on the hollow shaft 60, and the inlet cam 36 and the outlet cam 38 can be held on the inner shaft 62.

In the said third embodiment, a connecting apparatus 66 is preferably provided which can be switched over between a normal position and a braking position. In the normal position, the outlet cam follower 44 is drive-coupled to the outlet cam 38. In the braking position, the outlet cam follower 44 is coupled both to the outlet cam 38 and to the brake cam 40. As a result, in the braking position, the valve lift characteristic curve 58 of the outlet valve 22 is defined both by the outlet cam 38 and by the brake cam 40.

Figure 10:
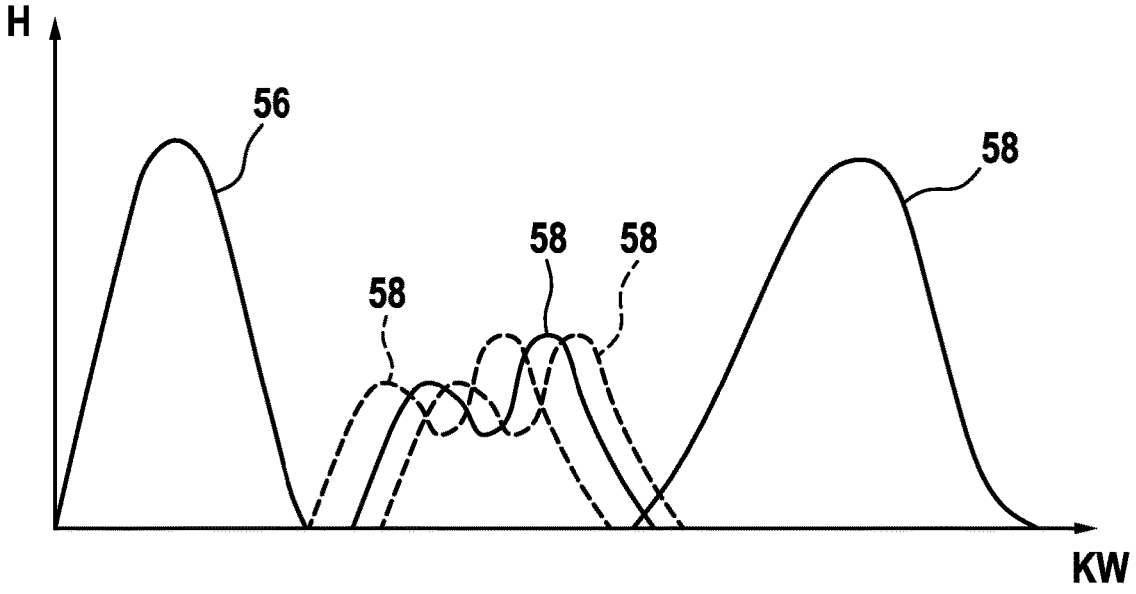
FIG. 10 shows a diagram with valve lift characteristic curves of an outlet valve and an inlet valve, in each case a valve lift H being shown plotted against a crank angle KW, and a brake cam being switched in, and the effect of the shift of the phase position of the brake cam being shown.

The phase shifting device 50 brings about a phase adjustment of the brake cam 40, however, with the result that (as can be seen in FIG. 10) the valve lift characteristic curve 56 of the inlet valve 20 is not shifted. Furthermore, that part of the valve lift characteristic curve 58 of the outlet valve 22 which is defined by way of the outlet cam 38 is likewise not shifted. Merely that part of the valve lift characteristic curve 58 of the outlet valve 22 which is defined by way of the brake cam 40 is displaced in the early direction or in the late direction.

Otherwise, the third embodiment (shown in FIGS. 9 and 10) of the reciprocating piston internal combustion engine 10 corresponds to the second embodiment (shown in FIGS. 7 and 8) of the reciprocating piston internal combustion engine 10 with regard to the construction and function; to this extent, reference is made to the above description of the said second embodiment.

It goes without saying that, in the case of all three embodiments, either a switchover apparatus 52 can be used for switching over between the outlet cam 38 and the brake cam 40 or, instead, a connecting apparatus 66 can be used, in the case of which the brake cam 40 is connected in the braking mode, and the outlet cam 38 and the brake cam 40 therefore together define the valve lift characteristic curve 58 of the outlet valve 22.

The invention claimed is:

1. A valve train for a reciprocating piston internal combustion engine, the valve train comprising:

a crankshaft;

at least one inlet valve and at least one outlet valve;

at least one camshaft coupled rotationally to the crankshaft;

at least one inlet cam;

at least one outlet cam;

at least one brake cam held together with the at least one outlet cam on a same one of the at least one camshaft;

at least one inlet cam follower, which actuates the at least one inlet valve and is drive-connected at least at times to the at least one inlet cam;

at least one outlet cam follower, which actuates the at least one outlet valve, is drive-connected at least at times to the at least one outlet cam, and, in a braking mode, is drive-connected at least at times to the at least one brake cam; and a phase shifter for adjusting a phase position of the at least one brake cam relative to the crankshaft;

wherein each of the at least one camshaft has a hollow shaft and an inner shaft, which runs in the hollow shaft, the hollow shaft and the inner shaft being configured to rotate relative to one another by way of the phase shifter;

wherein the at least one inlet cam is held on the same one of the at least one camshaft.

2. A valve train according to claim 1, wherein the at least one inlet cam is held on a first camshaft of the at least one camshaft, and the at least one brake cam and the at least one outlet cam are held on a second camshaft of the at least one camshaft.

3. A valve train according to claim 2, wherein the phase shifter is configured to adjust at least one phase position of the second camshaft with respect to the crankshaft.

4. A valve train according to claim 2, further comprising a switchover apparatus that is configured to switch between a braking position and a normal position, the at least one outlet cam follower being drive-connected to the at least one brake cam in the braking position, and the at least one outlet cam follower being drive-connected to the at least one outlet cam in the normal position.

5. A valve train according to claim 2, wherein the at least one brake cam and the at least one outlet cam are arranged axially next to one another.

6. A valve train according to claim 1, wherein one of:

the at least one inlet cam is held on the hollow shaft, and the at least one outlet cam is held together with the at least one brake cam on the inner shaft; or the at least one outlet cam is held together with the at least one brake cam on the hollow shaft, and the at least one inlet cam is held on the inner shaft.

7. A valve train according to claim 1, further comprising a switchover apparatus that is configured to switch between a braking position and a normal position, the at least one outlet cam follower being drive-connected to the at least one brake cam in the braking position, and the at least one outlet cam follower being drive-connected to the at least one outlet cam in the normal position.

8. A valve train according to claim 1, wherein the at least one brake cam and the at least one outlet cam are arranged axially next to one another.

9. A method for valve control in a reciprocating piston internal combustion engine via a valve train having a crankshaft, at least one inlet valve, at least one outlet valve, at least one camshaft coupled rotationally to the crankshaft, at least one inlet cam, at least one outlet cam, at least one brake cam, at least one inlet cam follower, which actuates the at least one inlet valve and is drive-connected at least at times to the at least one inlet cam, at least one outlet cam follower, which actuates the at least one outlet valve, is drive-connected at least at times to the at least one outlet cam, and, in a braking mode, is drive-connected at least at times to the at least one brake cam, and a phase shifter for adjusting a phase position of the at least one brake cam relative to the crankshaft, the method comprising:

drive-connecting the at least one outlet cam follower exclusively to the at least one outlet cam in a normal mode of the reciprocating piston internal combustion engine;

drive-connecting the at least one outlet cam follower to the at least one brake cam in the braking mode; and adjusting a phase position of the at least one brake cam with respect to the crankshaft in the braking mode in order to influence a braking action;

wherein the at least one inlet cam, the at least one outlet cam, and the at least one brake cam are held on a same one of the at least one camshaft; and wherein each of the at least one camshaft has a hollow shaft and an inner shaft, which runs in the hollow shaft, the hollow shaft and the inner shaft being configured to rotate relative to one another by way of the phase shifter.

10. A method according to claim 9, further comprising shifting the at least one brake cam in one of an early direction or a late direction in order to set a braking performance.

11. A method according to claim 9, further comprising:

shifting the phase position of the at least one brake cam in a late direction in order to increase the braking action; and shifting the phase position of the at least one brake cam in an early direction in order to reduce the braking action.

12. A method according to claim 9, wherein the phase position of the at least one brake cam with respect to the crankshaft is set independently of a phase position of the at least one inlet cam with respect to the crankshaft.

13. A method according to claim 9, wherein the phase position of the at least one brake cam with respect to the crankshaft is set independently of a phase position of the at least one outlet cam with respect to the crankshaft.

14. A valve train for a reciprocating piston internal combustion engine, the valve train comprising:

a crankshaft;

at least one inlet valve and at least one outlet valve;

at least one camshaft coupled rotationally to the crankshaft;

at least one inlet cam held on a first camshaft of the at least one camshaft;

at least one outlet cam held on one of the first camshaft or a second camshaft of the at least one camshaft;

at least one brake cam held on one of the first camshaft or the second camshaft;

at least one inlet cam follower, which actuates the at least one inlet valve and is drive-connected at least at times to the at least one inlet cam;

at least one outlet cam follower, which actuates the at least one outlet valve, is drive-connected at least at times to the at least one outlet cam, and, in a braking mode, is drive-connected at least at times to the at least one brake cam;

a phase shifter for adjusting a phase position of the at least one brake cam relative to the crankshaft; and a switchover apparatus that is configured to switch between a braking position and a normal position, the at least one outlet cam follower being drive-connected to the at least one brake cam in the braking position, and the at least one outlet cam follower being drive-connected to the at least one outlet cam in the normal position.

* * * * *